US007241188B2

(12) United States Patent
Lin et al.

(10) Patent No.: US 7,241,188 B2
(45) Date of Patent: Jul. 10, 2007

(54) AUDIO CONNECTOR WITH A PUSH BUTTON ENGAGING A CAM

(75) Inventors: Mike H. Lin, Cerritos, CA (US); Joon T. Kim, Los Angeles, CA (US)

(73) Assignee: International Connectors & Cable Corporation, Cerritos, CA (US)

( * ) Notice: Subject to any disclaimer, the term of this patent is extended or adjusted under 35 U.S.C. 154(b) by 0 days.

(21) Appl. No.: 11/228,968

(22) Filed: Sep. 16, 2005

(65) Prior Publication Data

US 2007/0066143 A1 Mar. 22, 2007

(51) Int. Cl.
*H01R 4/48* (2006.01)

(52) U.S. Cl. ..... 439/838

(58) Field of Classification Search ..... 439/838, 439/441, 834, 835, 488, 775, 786, 557, 346; 381/150

See application file for complete search history.

(56) References Cited

U.S. PATENT DOCUMENTS 5,893,772 A * 4/1999 Carmo et al. ..... 439/346
6,106,330 A * 8/2000 Lin ..... 439/557
6,193,539 B1 * 2/2001 Chang ..... 439/346
6,250,950 B1 * 6/2001 Pallai ..... 439/441
6,712,649 B2 * 3/2004 Mano et al. ..... 439/835
7,056,157 B2 * 6/2006 Herring et al. ..... 439/680
7,059,920 B2 * 6/2006 Billow et al. ..... 439/838

OTHER PUBLICATIONS

Brochure of ICC™ Structured Cabling Solutions, Registered to ISO 9001, submitted section entitled Multi-Port Solutions, MPS, (2001) pp. 10-23.
11 sheets of photographs of Magnovox Speaker Wall Plate, Audio, M62073.

* cited by examiner

*Primary Examiner*—Chandrika Prasad
(74) *Attorney, Agent, or Firm*—Christie, Parker & Hale, LLP

(57) ABSTRACT

Electrical connectors are generally discussed herein with particular discussions on spring clip connectors for connecting wires to electronically link a first audio component to a second audio component. The connectors provided herein incorporate at least one push button, at least one cam, at least one conductor, and at least one biasing member inside a housing. The at least one push button is configured to translate when depressed to then rotate the at least one cam to open a receptacle for receiving a wire. The wire is then placed in contact with the at least one conductor when the at least one push button is released.

29 Claims, 4 Drawing Sheets

TOP
3F
3D

28/30
18/20
22/24
22
7B
5D

AUDIO CONNECTOR WITH A PUSH BUTTON ENGAGING A CAM

Electrical connectors are generally discussed herein with particular discussions on spring clip connectors for connecting wires to electronically link a first audio component to a second audio component.

BACKGROUND

There are a variety of connectivity products that can be used to connect wire from audio equipment, such as tuners, amplifiers and equalizers, to speaker equipment. The most common types of connectivity products are binding posts, banana jacks and plugs and spring clips. Spring clips are particularly desirable when used with large gauge stranded wire favored by audiophiles for clarity of signal transmission because the clips crush the strands of the wire, placing as many strands as possible in direct contact with a conductor. Connectivity products are typically provided in pairs, one being marked red and the other being marked black, to identify and aid maintenance of proper polarity in the wiring connections between the output component and the speaker component.

Banana jacks and binding posts are often available as modules, i.e., with the red and black connections as separate components. These multi-port modular solutions involve the mating of the banana jack or binding post module into a faceplate port without the use of solder or screws. Despite the popularity of spring clips, spring clips are only available in a few varieties or types, including a duplex type with two connections mated into a common housing. Some of these duplex modules may be mounted onto faceplates to provide a fixed or pre-configured solution. Another spring clip connector is shown in U.S. Publication No. 2004/0266275, which is expressly incorporated herein by reference, and is commonly own by the Applicant. However, there is a need for spring clips to be provided as modules so that screws or other attachment means requiring installation tools are not required to install them onto a faceplate.

The faceplate port and modular insert concept was developed with the idea of producing a flush face when a voice or data jack was inserted. However, with the expansion of products to include modules that protrude beyond the faceplate, the ability to negotiate the module through the port of a faceplate becomes more difficult. Thus, there is also a need to provide a modular spring clip connector that, while protruding from the port of a faceplate, is easy to install and provides a secure connection.

SUMMARY

Embodiments of the present invention comprise a connector assembly for connecting a first audio component to a second audio component comprising: a housing comprising a plurality of walls, including a front wall, defining an interior cavity; the front wall comprises a receptacle for receiving a wire and a tab opening; a push button positioned at least partially inside the interior cavity of the housing and partially out of the tab opening in mechanical communication with a cam comprising an arm; and a conductor having a distal end and a proximal end positioned proximate the receptacle; wherein the push button translates when pushed and the cam moves when pushed to both move from a first position to a second position, wherein the arm is spaced apart from the proximal end of the conductor a first distance when in the first position and a second distance when in the second position; and wherein the second distance is greater than the first distance.

Preferably, the spring clip connector provided in accordance with aspects of the present invention comprises a connector assembly for connecting a first audio component to a second audio component comprising: a housing comprising a plurality of walls, including a front wall and at least one side wall, defining an interior cavity; the front wall comprising a receptacle for receiving a wire and a tab opening; the at least one side wall comprising a housing ledge; a push button comprising an engagement section and a button ledge; a cam comprising a pivoting bore and an arm comprising a connection end; a shaft extending through the pivoting bore for supporting the cam as the cam rotates; and a conductor comprising a proximal end positioned proximate the receptacle; wherein the button ledge on the push button contacts the housing ledge and the connection end of the cam contacts the engagement section of the push button; and wherein the button ledge slides relative to the housing ledge and the connection end rotates relative to the engagement section when the push button is depressed.

In yet another aspect of the present invention, there is provided a connector assembly for connecting a first audio component to a second audio component comprising: a housing comprising a proximal end, a distal end, and having a receptacle and a tab opening at the proximal end; a button means for being pushed projecting through the tab opening and in sliding communication with a housing sliding means; a shaft; a cam means for being pivoted comprising an arm positioned proximate the receptacle in pivoting communication with the button means and the shaft; and wherein the button means is configured to translate when depressed and rotates the cam means, which moves the arm to open the receptacle.

Other aspects of the present invention include a housing for accommodating a pair of push buttons, a pair of cams, a pair of conductors, and a pair of biasing members for connecting a pair of wires.

Yet in other aspects of the present invention, there is provided a cantilever latch for flexing and latching the housing to a faceplate.

Aspects of the present invention also include a modular housing for mating assembly with a standard keystone faceplate.

In still yet other aspects of the present invention, a push button is configured to translate relative to the housing while a cam is configured to rotate relative to a shaft, which is positioned inside the housing.

BRIEF DESCRIPTION OF THE DRAWINGS

These and other features and advantages of the present invention will become appreciated as the same become better understood with reference to the specification, claims and appended drawings wherein:

DETAILED DESCRIPTION

The detailed description set forth below in connection with the appended drawings is intended as a description of the presently preferred embodiments of spring clip connectors provided in accordance with aspects of the present invention and is not intended to represent the only forms in which the present invention may be constructed or utilized. The description sets forth the features and the steps for constructing and using embodiments of the spring clip connectors of the present invention in connection with the illustrated figures. It is to be understood, however, that the same or equivalent functions and structures may be accomplished by different embodiments that are also intended to be encompassed within the spirit and scope of the invention.

Figures 1, 2:
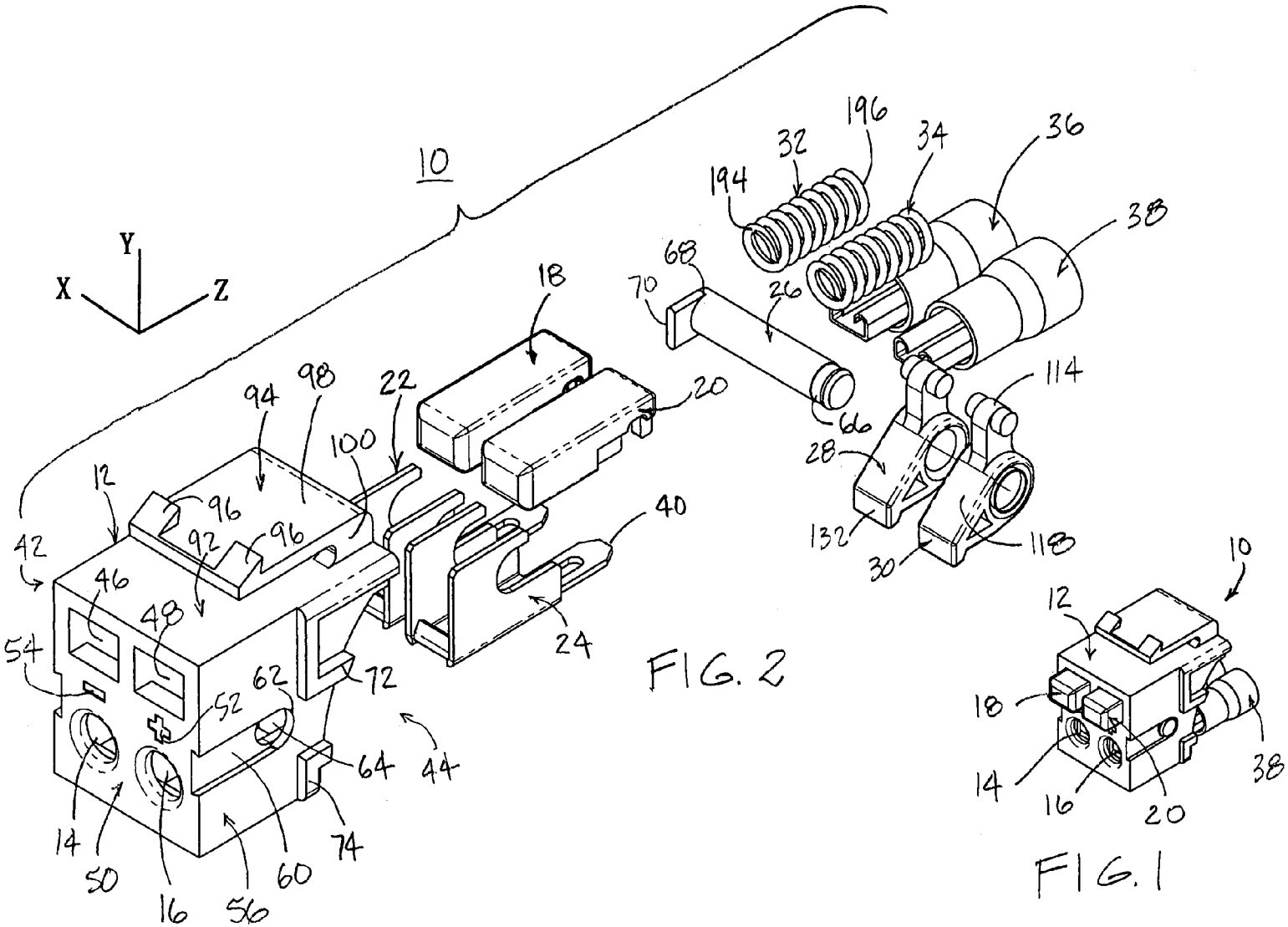
FIG. 1 is a semi-schematic perspective view of a spring clip connector provided in accordance with aspects of the present invention.
FIG. 2 is a semi-schematic exploded perspective view of the connector of FIG. 1, which shows various connector components.

Referring now to FIG. 1, a semi-schematic perspective view of an exemplary spring clip connector provided in accordance with aspects of the present invention is shown, which is generally designated 10. In one exemplary embodiment, the spring clip connector 10 (hereinafter "connector") comprises a housing 12 comprising two receptacles or openings 14, 16 for receiving two wires, such as a signal wire and a ground wire (not shown) connected to an audio component, such as an amplifier or a receiver. A pair of push buttons 18, 20 are movably received in the housing 12 for opening and closing the two receptacles 14, 16 when depressed or pushed, as further discussed below. The push buttons 18, 20 are preferably color coded, such as with a red color and a black color, to facilitate maintenance of proper polarity between the signal wire and the ground wire of the audio components to be connected.

Referring now to FIG. 2, a semi-schematic exploded perspective view of various components of the connector 10 is shown, which include the housing 12, the two push buttons 18, 20, a pair of conductors or contacts 22, 24, a shaft 26, a pair of cams 28, 30, a pair of resilient or biasing members 32, 34, and a pair of contact terminals 36, 38, which can be of various types including a push-on type terminal shown for mating contact with the tabs 40 on the two conductors 22, 24.

Reference is now made to the housing 12 shown in FIG. 2 in combination with the housing shown in FIGS. 3A-3F. In one exemplary embodiment, the housing 12 is configured for mating assembly with a faceplate, such as a keystone-type faceplate (See, e.g., FIG. 8). The housing is modular and is sized to fit an opening of a keystone faceplate. The housing incorporates latching means for latching or engaging the mounting means located on the faceplate to couple the two together, as further discussed below.

In accordance with aspects of the present invention, the housing comprises a front side or end 42 and a back side or end 44 defining a longitudinal axis extending in the direction from the front side to the back side, or vice versa. The front side 42 may also be referred to as the proximal end or side while the back side 44 the distal end or side. A front wall 50 located on the proximal end is configured to receive wires by incorporating the two wire receptacles 14, 16 for receiving at least two separate wires. Two tab openings 46, 48 are also incorporated on the front wall 50 for receiving two push buttons 18, 20. Wiring indicia may also be incorporated for facilitating proper wiring. In one exemplary embodiment, a positive indicia 52 and a negative indicia 54 are incorporated for ensuring proper polarity.

A left side wall 56 and a right side wall 58 extend from the front wall 50. In one exemplary embodiment, the two side walls 56, 58 incorporate identical structures or features. For ease of discussion, only the features of the left side wall 56 will be discussed as the same apply to the right side wall 58. In one exemplary embodiment, a channel 60 is incorporated on the left side wall 56, which extends co-linearly along the longitudinal axis of the housing. The channel 60 originates from the intersection between the front wall 50 and the left side wall 56 and extends sufficiently distally towards the back end 44 of the housing. Interiorly, a similar channel 61 (FIG. 3A) is incorporated on the side wall originating from the distal end towards the proximal end.

In one exemplary embodiment, the channel 60 comprises an arcuate end 62 and a shaft opening 64 for receiving one of the ends of the shaft 26, which has a terminal end 66 and a tab end 68 comprising a tab 70. The shaft 26 is insertable through the opening 64 by pushing the terminal end 66 of the shaft through the opening 64 and aligning the tab 70 on the tab end 68 of the shaft to fit into the channel 60, i.e., to recess within the race defined by the channel 60. The channel 60 functions as a channel lock when it interacts with the tab 70 to prevent the shaft 26 from rotating about the axis defined by the two shaft openings 64 on the left side wall 56 and the right side wall 58.

In one exemplary embodiment, at least one rib 72 is incorporated on the left side wall 56. With reference to the X-Y-Z coordinates shown in FIG. 2, the at least one rib 72 comprises a length extending from the surface of the side wall along the X direction and along the Y direction. The rib is configured to abut a bracket means on a keystone faceplate to delimit proximal movement of the housing 12 once mounted inside an opening of the faceplate. In a preferred embodiment, an upper rib 72 and a lower rib 74 are incorporated to provide added stability. The lower rib 74 also comprises a length extending from the surface of the side wall along the X direction and along the Y direction Although both ribs 72, 74 are shown with a length extending in the Z direction, the Z-direction components may be eliminated without deviating from the spirit and scope of the present invention. When incorporated, the Z-direction components provide added material thickness and strength to the housing integrity of the spring clip connector, which is preferred.

Figures 3A, 3B, 3C, 3D, 3E, 3F:
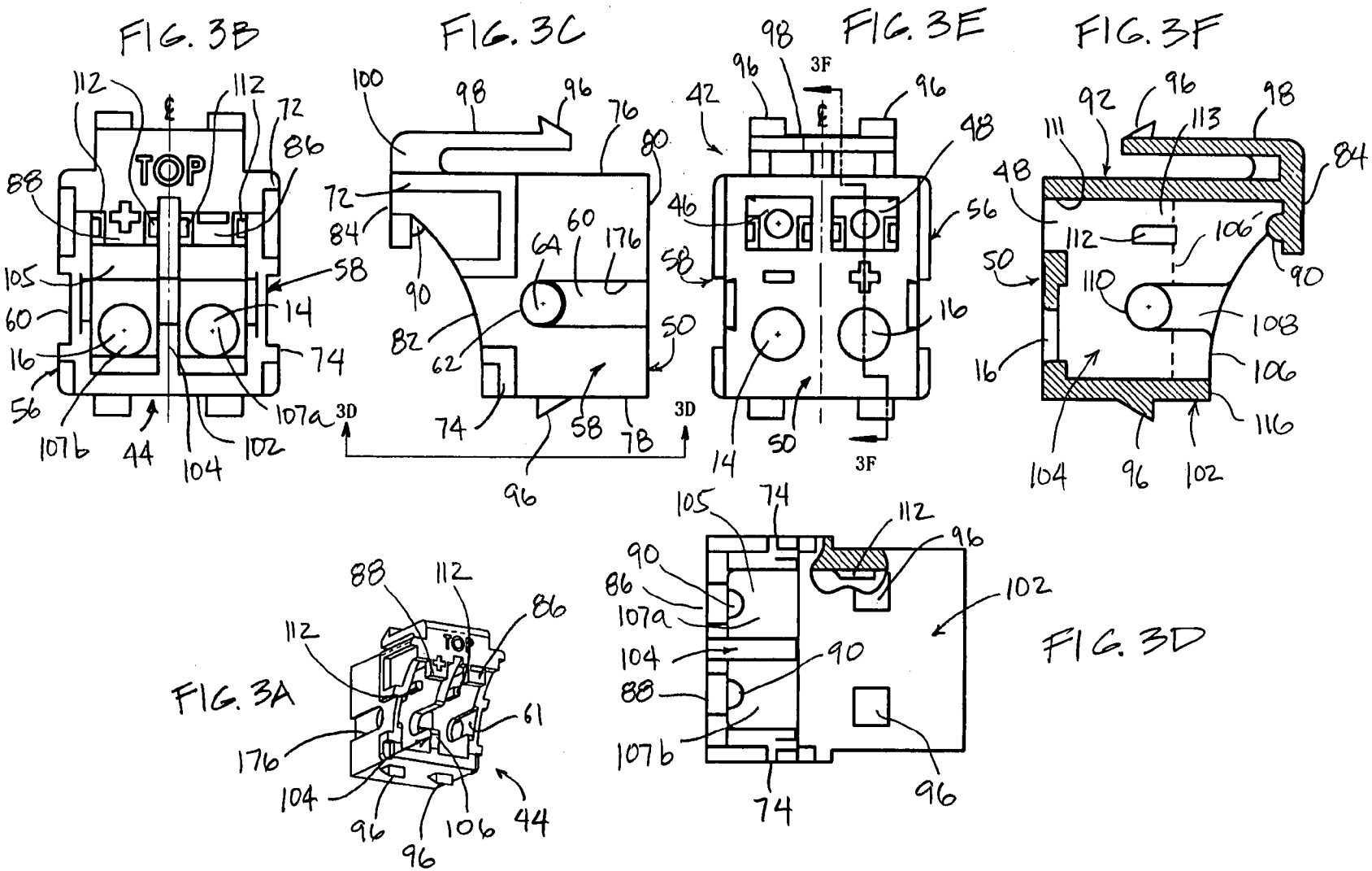
FIGS. 3A-3F are various views of the connector housing provided in accordance with aspects of the present invention.

Referring specially now to FIG. 3C, the right side wall 58, which is identical to the left side wall 56, comprises a top edge 76, a bottom edge 78, a front edge 80, and a rear edge 58. The top edge 76 is preferably longer than the bottom edge 78 and the rear edge 82 comprises a curve or a bend. This configuration forms a void or an access space at the distal end of the housing 12. The space facilitates access into the interior cavity defined by the housing 12 for assembling the various connector components, as further discussed below. The rear edge 82 intersects a downwardly extending rear wall 84 (FIGS. 3A, 3C, 3F). Two downwardly extending tabs 86, 88 (FIGS. 3A and 3B) are formed on the rear wall, which are configured to support the two biasing members 32, 34 when the biasing members are assembled to the housing. The tabs 86, 88 each incorporates a post or a bump 90 (FIGS. 3C, 3D, and 3F) for projecting into one of the free ends of the biasing members 32, 34 to position the biasing member within the interior cavity of the housing, as further discussed below.

The top wall 92 of the housing 12 comprises a cantilever latch 94 comprising a pair of ramp pieces 96. The ramp pieces 96 each comprises a sloped surface with increasing slope in the distal direction. The ramp pieces 96 function as male detents for engaging with corresponding female detents or other engaging means located on the faceplate. In one exemplary embodiment, the cantilever latch 94 comprises a proximally extending platform 98 and a base 100 secured to the top wall 92. More preferably, the base 100 and the platform 98 are integrally formed to the top wall 92, although the two may be separately formed and subsequently attached using, for example, heat welding or laser welding. In an alternative embodiment, only a single ramp piece is incorporated.

In one exemplary embodiment, the bottom wall 102 of the housing (FIG. 3D, which is taken along line 3D-3D of FIG. 3C) comprises a pair of ramp pieces 96 for engaging the engagement means located on the keystone-type faceplate. The bottom two ramp pieces 96 have similar sloped surfaces as previously described for the upper ramp pieces. In an alternative embodiment, only a single lower ramp piece is incorporated.

A partition wall 104 is incorporated in the interior cavity 105 of the housing 12. The partition wall 104 divides the interior cavity 105 into two interior cavity sections 107*a*, 107*b* for separately accommodating the two push buttons 18, 20, the two cams 28, 30, the two conductors 22, 24, the two biasing members 32, 34, and the two contact terminals 36, 38. With reference to FIG. 3F, which is a cross-sectional side view of the housing of FIG. 3E taken along line 3F-3F, the partition wall 104 comprises a back edge 106 having a similar contour as the back edge 82 of the two side walls 56, 58. An open channel 108 comprising an arcuate end 110 is incorporated in the partition wall 104. The arcuate end 110 is aligned with the two shaft openings 64 on the two side walls 56, 58 for accommodating the shaft 26 as the same is positioned in the interior cavity 105 of the housing and extends between the two shaft openings 64 and through the arcuate end 110 of the partition wall.

A projection 112 is formed on the partition wall 104 slightly above the arcuate end 110 of the open channel 108, on both sides of the partition wall. A similar projection 112 is formed on the interior surface of the left wall 56 and the interior surface of the right wall 58 (See, e.g., FIGS. 3A and 3B). The four projections 112 cooperate to retain the two cams 28, 30 within the upper interior cavity section and the two push buttons 18, 20 as the push buttons travel to and fro when depressed and released to open and then close the receptacles 14, 16, as further discussed below. The four projections 112 are positioned just slightly below the interior surface 111 of the top wall 92 (FIG. 3F) and each is spaced apart from the interior surface of the top wall by a gap 113 sufficient to accommodate a guide 150 located on the push button, as further discussed below.

In an alternative embodiment, the distal end edge 106 of the partition wall 104 terminates short of the edge 116 of the bottom wall 102. In one exemplary embodiment, the rear edge 106 of the partition wall 104 terminates at approximately the distal edge of the projection 112, shown in FIG. 3F in dashed-dot lines 106'. The housing is preferably molded from a thermoplastic material. Exemplary thermoplastic materials useable for molding the housing include PVC, ABS, PP, or other rigid plastic equivalents.

Figures 4A, 4B, 5A, 5B, 5C, 5D, 6A, 6B, 6C, 7A, 7B, 7C:
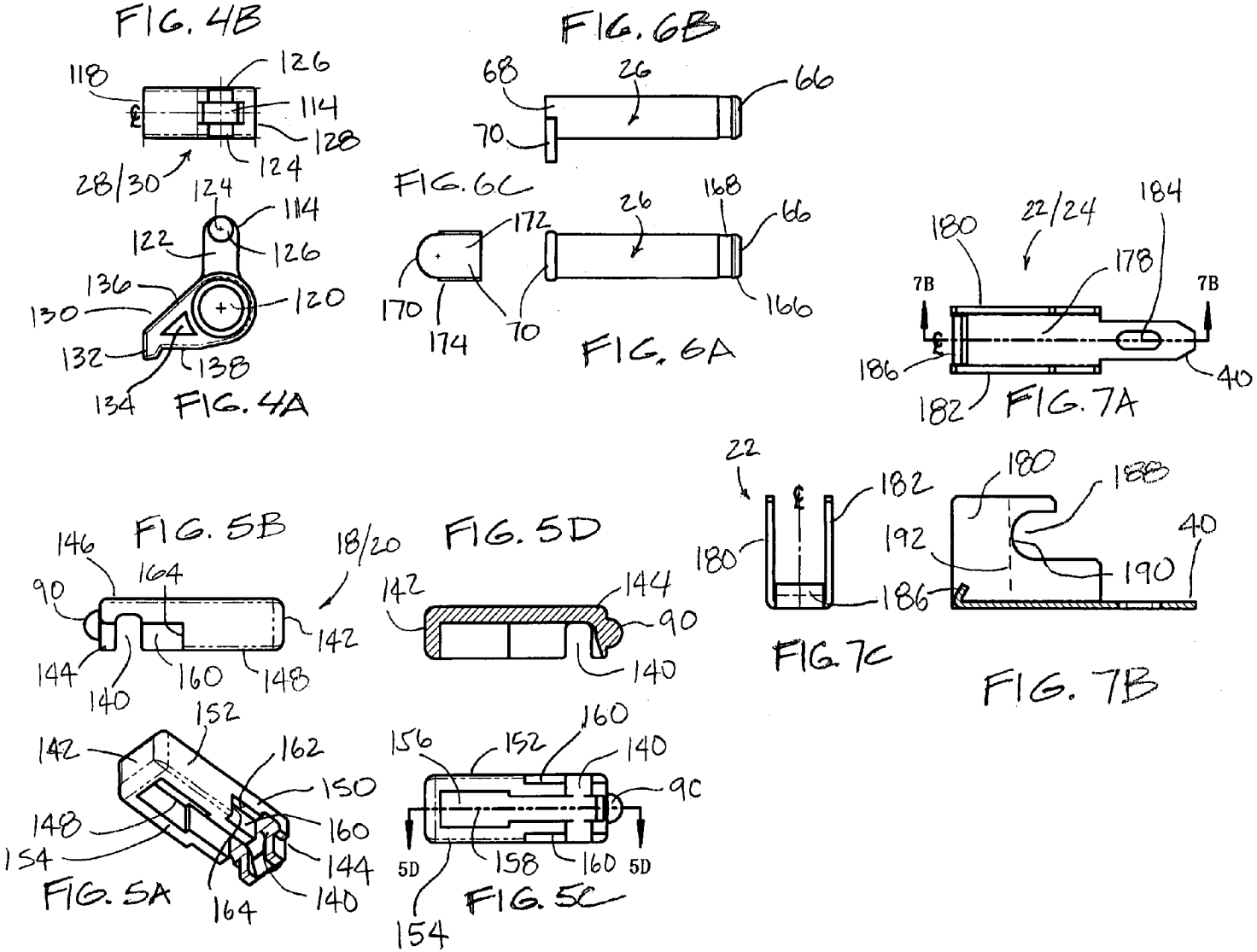
FIGS. 4A-4B are various views of a cam provided in accordance with aspects of the present invention.
FIGS. 5A-5D are various views of a push button provided in accordance with aspects of the present invention.
FIGS. 6A-6C are various views of a shaft provided in accordance with aspects of the present invention.
FIGS. 7A-7C are various views of a conductor provided in accordance with aspects of the present invention

Referring now to FIGS. 4A and 4B, a side view and a top view of a cam 28 or 30 is shown, which shall hereinafter be referred to as cam 28. In one exemplary embodiment, the cam 28 comprises a rocker arm 114, a load arm 118, and a pivoting bore 120. The rocker arm 114 comprises an arm extension 122 and two generally cylindrical rods 124 projecting therefrom on an end thereof. The two cylindrical rods 124 are configured to seat in a groove or rod channel 140 (FIGS. 5A and 5B) of a push button and the end faces 126 are each configured to pass between a pair of projections 112, one formed on the partition wall 104 and a second on one of the two side walls 56, 58 (FIG. 3B), when the cam 28 is moved by a push button.

In one exemplary embodiment, the load arm 118 comprises arm extension 130 comprising a load pin 132 extending therefrom on an end thereof. In one particular aspect of the present invention, the arm extension 130 comprises a generally rectangular configuration having a generally rectangular bore 134 formed therethrough separating the arm extension 130 into an upper arm section 136 and a lower arm section 138. The load pin 132 extends or projects below the lower arm section 138 at a generally orthogonal angle from the lower arm section with other non-orthogonal angles contemplated. When the connector is in a closed position as shown in FIG. 1, the two load pins 132 act as a gate to at least partially occlude the two receptacle 14, 16.

In use, a force exerted on a push button 18 moves the push button from a first or proximal position to a second or distal position. The push button is mechanically coupled to the cam, and more particularly to the rocker arm 114 as further discussed below, and moves the cam 28 from a first position to a second position. Because the pivoting bore 120 is in pivoting relationship with the shaft 26, the cam 28 rotates about an axis defined by the shaft, which causes the load arm 118, and hence the load pin 132, to move from a first position to a second position. The total arc length travel of the rocker arm 114 and the load arm 118 in moving from a first position to a second position depends on their respective lengths measured from the center of the pivoting bore 120 to an outermost edge of the two arm extensions 122, 130, which in a preferred embodiment is the same.

FIGS. 5A-5D show various views of a push button 18 or 20 provided in accordance with aspects of the present invention. For discussion purposes, the push button shall be referred to as push button 18, which is identical to push button 20. The push button 18 comprises a push end 142, a support end 144 (FIG. 5D, which is a cross-sectional side view of FIG. 5C taken along line 5D-5D), a top side 146, a bottom side 148, a left side 152, and a right side 154. The push button 18 has a hollow interior cavity 156 defining an elongated main channel 160 having an open bottom side having a rod channel 140 formed coincident therewith. When assembled, the rod channel 140 is configured to accommodate the two cylindrical rods 124 located on the cam 28 while the elongated main channel 158 is configured to accommodate the arm extension 122.

In one exemplary embodiment, two indented side sections 160 are formed adjacent the rod channel 140. Each indented side section 160 comprises a length extending along the push end 142 towards the support end 144 of the push button and a height extending along the top side 146 towards the bottom side 148 of the push button. A button ledge 162 is formed at the intersection between the guide 150 and the indentation section 160. In use, the guide 150 is configured to slide between the gap 113 defined by the projection 112 (FIG. 3F) and the interior surface 111 of the top wall 92 while the ledge 162 is configured to ride or abut against the upper surface of the projection 112, which may be called or considered a housing ledge. The length of each indented side section 160 should be sufficiently long so that as the push button 18 traverses from a proximal position to a distal position and vice versa during use, the distally facing edge 164 does not delimit movement of the push button 18 by prematurely abutting the projection 112 before the push button translates to a desired final position.

FIGS. 6A-6C show various views of a shaft 26 provided in accordance with aspects of the present invention. In one exemplary embodiment, the shaft 26 comprises a tapered edge 166 and a groove 168 at the terminal end 66 and a tab 70 at the tab end 68. The tapered edge 166 is incorporated to facilitate assembly by deflecting the shaft when the edge contacts the opening 64 on either the left side wall 56, the right side wall 58, and/or the channel 108 (FIG. 3F) of the partition wall 104. The groove 168 is incorporated to permit play or slack when the same is positioned inside the shaft opening 64 of either the left 56 or the right 58 side wall. As is readily apparent to a person of ordinary skill in the art, the tapered edge 166 and/or the groove 168 may be eliminated (i.e., not incorporated) without deviating from the spirit and scope of the present invention. In one exemplary embodiment, the opening 64 on the right side wall 58 is larger than the opening 64 on the left side wall 56 and the shaft 26 is configured to enter through the opening 64 on the right side wall 58 and pushed through so that the tapered edge 166 of the shaft pop lock into the smaller opening 64 of the left side wall 56.

In one exemplary embodiment, the tab 70 comprises an arcuate end 170 and a generally square end 172 integrally formed to the tab end 68 of the shaft 26. A bevel or tapered perimeter trim 174 is incorporated around the generally square end 172. When the shaft 26 is assembled to the housing 12 (See, e.g., FIG. 1), the perimeter trim 174 provides an interference fit against the race 176 (FIG. 3C) defined by the channel 60 located on either the left side wall 56 or the right side wall 58 to removably retain the shaft to the housing. Alternatively or in addition thereto, adhesive, glue, or other bonding means, such as heat or laser welding, may be used to retain the shaft 26 to the housing 12. The shaft 26, the two cams 28, 30, and the two push buttons 18, 20 are preferably made from a thermoplastic material, such as polycarbonate. In one exemplary embodiment, the two cams and the two push buttons are preferably color coded to facilitate proper wiring connectivity. For example, one cam and one push button may have a red color while the other cam and the other push button a black color.

FIGS. 7A-7C show various views of a conductor 22 or 24 provided in accordance with aspects of the present invention. For discussion purposes, the conductor shall be referred to as conductor 22, which is identical to conductor 24. In one exemplary embodiment, the conductor 22 comprises a base 178 and two side walls 180, 182 integrally formed from a conductive material, such as brass, copper, iron, or other conductive metal. The base 178 comprises a tab 40 comprising an optional opening 184 and a lip 186. When installed, the lip 186 cooperates with the load pin 132 on the cam 28 (FIG. 4A) to pinch the bare wire end of a signal or ground wire inserted into the front receptacle 14 or 16 (FIG. 2) of the housing 12. The contact between the lip 186 and the bare wire opens electrical communication between a first audio component connected to the wire and a second audio component connected to the tab 40.

In one exemplary embodiment, a channel 188 is incorporated on each side wall 180, 182 of the conductor (See, e.g., FIG. 7B, which is a cross-sectional side view of FIG. 7A taken along line 7B-7B). The channel 188 each comprises an arcuate end 190. When the conductor 22 is installed in the housing 12, the two arcuate ends 190 of the two channels 188 align with the arcuate end 110 on the partition wall 104 and the arcuate ends 62 located on the left 56 and the right 58 side walls of the connector housing 12. The alignment allows the shaft 26 to be inserted through the shaft opening 62 on one side wall 56 or 58 and extend through to the shaft opening of the other side wall. In an alternative embodiment, the two side walls 180, 182 may be shortened and terminate along the dot-dashed lines 192.

The connector 10 is assembled by first turning the housing upside down (FIG. 3D) and placing the two push buttons 18, 20 through the two tab openings 46, 48 at the front wall 50 of the housing 12, with the support end 144 of the push button inserted in first. Holding tools, such as tweezers, may be used to hold the various parts during assembly of the spring clip connector. The two cams 28, 30 are then installed by aligning the rocker arms 114 so that the cylinder rods 124 fit into the rod channels 140 of the push buttons 18, 20 and the loading pins 132 point towards the bottom wall 102 of the housing, in the orientation shown in FIG. 2. Place the assembly so that surface 50 is facing down, making sure that the cylinder rod 124 and the rod channel 140 are still engaged.

The two conductors 22, 24 are then slid into the two interior chambers 107*a*, 107*b* in the orientation shown in FIG. 2. The shaft 26 is then inserted through the shaft opening 64 of either the left side wall 56 or the right side wall 58 until the tab 70 is recessed and aligned within the channel 60. The two biasing members 32, 34 are installed next by inserting the first open ends 194 over the bumps 90 located on the support end 144 of the two push buttons 18, 20 and then manipulating the two biasing members 32, 34 while wedging the second open ends 196 over the bumps 90 located on the two downwardly extending tabs 86, 88 located on the rear wall 84 of the housing 12. The two contact terminals 36, 38 are then connected to the two tabs 40 located on the two conductors 22, 24.

Figure 8:
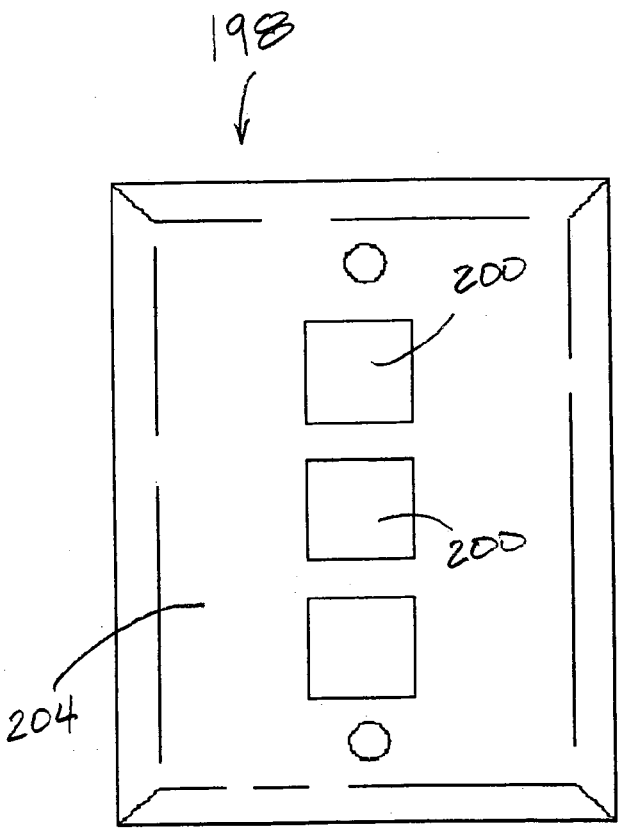
FIG. 8 is a semi-schematic front view of an exemplary Keystone-type faceplate.
Figure 9:
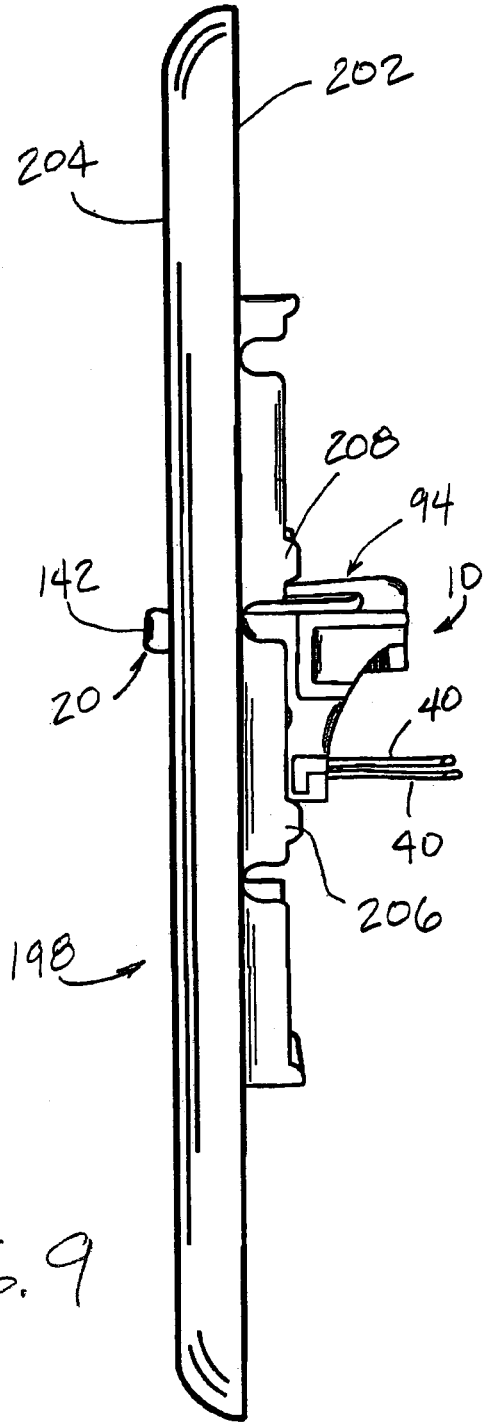
FIG. 9 is a semi-schematic side view of the spring clip connector of FIG. 1 mounted to the faceplate of FIG. 8.

As previously discussed, the connector 10 is configured for mating assembly with a keystone-type faceplate, an exemplary of which is shown in FIG. 8, which is a three gang faceplate 198. The connector 10 may be assembled to the faceplate 198 by inserting the front wall 50 of the connector 10 in first through an opening 200 on the faceplate from a rear surface 202 of the faceplate 198 towards a font surface 204 of the faceplate. The connector 10 is angled so that the two ramp pieces 96 on the bottom wall 102 latch against a first mounting surface 206 on the faceplate 198 (FIG. 9). The connector 10 is then pushed so that the cantilever latch 94 flexes under a second mounting surface 208 on the faceplate and the two ramp pieces 96 of the cantilever latch 94 engage the second mounting surface 208. Because the connector 10 is installed from a rear surface 202 of the faceplate and pushed forward towards the front surface 204 of the faceplate to a latching position, the push end 142 of the two push buttons 18, 20 move away from the front surface 204 of the faceplate 198 as the connector 10 latches to the two mounting surfaces 206, 208 of the faceplate 198. As is readily apparent to a person of ordinary skill in the art, while the steps for assembling the various components of the connector 10 are discussed in pairs, the components can each be assembled sequentially or in a different sequence than as described.

Once mounted, the connector 10 is configured to receive two wires, such as a signal wire and a ground wire. The two wires, preferably the two bare ends of the two wires, are connected to the connector 10 by pushing the two push buttons 18, 20 distally to open the two receptacles 14, 16 The receptacles are normally at least partially occluded by the two loading pins 132 located on the two cams 28, 30. In a closed position, the two loading pins 132 are normally urged towards the conductors 22, 24, more particularly towards the two lips 186 located on the two conductors, when in the closed position by the two biasing members 32, 34. As the push buttons 18, 20 move distally, they compress the two biasing members 32, 34 and move the rocker arms 114 located on the two cams 28, 30, which are connected to the push buttons at the rod channel 140 and the main channel 158. Concurrently therewith, the cams 28, 30 rotate about the axis defined by the shaft 26 and the two load arms 118 rotate to lift the two load pins 132 to a spaced apart position from the two lips 186 located on the two conductors 22, 24.

Following insertion of a ground wire and a signal wire into the two receptacles 14, 16, the two push buttons 18, 20 are released. The push buttons 18, 20 are then urged proximally by the two biasing members 32, 34, which then rotate the two cams in an opposite rotation to move the loading pins 132 toward the lips 186 of the two conductors 22, 24 to compress the wires therebetween. The compression provides a solid electrical contact between the two wires and the two conductors 22, 24. As is readily apparent to a person of ordinary skill in the art, the compression is provided by the biasing force of the two biasing members 32, 34 and the geometry of the two cams 28, 30.

Although limited embodiments of the connector assemblies and their components have been specifically described and illustrated herein, many modifications and variations will be apparent to those skilled in the art. For example, the various components may be sized differently to fit a different faceplate, the housing may be modified to accept a single wire by incorporating a single push button, a single cam, etc., and the components and/or the housing may have different colors, textures, and other indicia for aesthetic appeal. Accordingly, it is to be understood that the connector assemblies and their components constructed according to principles of this invention may be embodied other than as specifically described herein. The invention is also defined in the following claims.

What is claimed is:

1. A connector assembly for connecting a first audio component to a second audio component comprising:

a housing comprising a plurality of walls, including a front wall, defining an interior cavity; the front wall comprises a receptacle opening for receiving a wire and a tab opening;

a push button positioned at least partially inside the interior cavity of the housing and partially out of the tab opening in mechanical communication with a cam comprising an arm; and a conductor having a distal end and a proximal end positioned proximate the receptacle opening;

wherein the push button moves when pushed and the cam moves when pushed to move to an open position to open the receptacle opening for receiving the wire, and wherein the cam moves about an axis defined by a shaft.

2. The connector assembly as recited in claim 1, further comprising a cantilever latch for latching the housing to a faceplate.

3. The connector assembly as recited in claim 1, wherein the housing is attached to a faceplate.

4. The connector assembly as recited in claim 1, wherein the shaft projects through an opening on the cam.

5. The connector assembly as recited in claim 4, wherein the shaft comprises two ends, both of which are in contact with the housing.

6. The connector assembly as recited in claim 1, wherein the front wall further comprises a second receptacle opening and a second tab opening.

7. The connector assembly as recited in claim 1, further comprising at least one of a positive indicia and a negative indicia on an exterior surface of the housing.

8. The connector assembly as recited in claim 1, wherein the push button is at least one of a red color and a black color.

9. The connector assembly as recited in claim 2, wherein the cantilever latch is integrally formed to a top wall of the housing.

10. The connector assembly as recited in claim 1, further comprising a side opening on a left wall and a side opening on a right wall.

11. The connector assembly as recited in claim 4, wherein the shaft comprises a tab at on at least one of the two ends.

12. The connector assembly as recited in claim 2, further comprising at least one ramp piece on the cantilever latch.

13. The connector assembly as recited in claim 12, further comprising at least one ramp piece on a bottom wall of the housing.

14. The connector assembly as recited in claim 1, wherein the cam rotates when pushed by the push button.

15. A connector assembly for connecting a first audio component to a second audio component comprising:

a housing comprising a plurality of walls, including a front wall and at least one side wall, defining an interior cavity; the front wall comprising a receptacle opening for receiving a wire and a tab opening; the at least one side wall comprising a housing ledge;

a push button comprising an engagement section and a button ledge;

a cam comprising a pivoting bore and an arm comprising a connection end;

a shaft extending through the pivoting bore for supporting the cam as the cam rotates; and a conductor comprising a proximal end positioned proximate the receptacle opening;

wherein the button ledge on the push button contacts the housing ledge and the connection end of the cam contacts the engagement section of the push button; and wherein the button ledge slides relative to the housing ledge and the connection end rotates relative to the engagement section when the push button is depressed.

16. The connector assembly as recited in claim 15, further comprising a cantilever latch for latching the housing to a faceplate.

17. The connector assembly as recited in claim 15, wherein the housing is attached to a faceplate.

18. The connector assembly as recited in claim 15, wherein the shaft comprises a tapered edge at one end of the shaft and a tab at a second end of the shaft.

19. The connector assembly as recited in claim 15, wherein the conductor comprises a tab for mating contact to a contact terminal.

20. The connector assembly as recited in claim 16, wherein the cantilever latch is integrally formed to a top wall of the housing.

21. The connector assembly as recited in claim 15, further comprising a resilient element for pushing the cam and the push button to their respective first position.

22. The connector assembly as recited in claim 15, further comprising a second receptacle opening and a second tab opening.

23. The connector assembly as recited in claim 15, further comprising at least one of a positive indicia and a negative indicia on an exterior surface of the housing.

24. A connector assembly for connecting a first audio component to a second audio component comprising:

a housing comprising a proximal end, a distal end, and having a receptacle opening and a tab opening at the proximal end;

a button for being pushed projecting through the tab opening and in sliding communication with a generally planar surface on the housing;

a shaft;

a conductor located, at least in part, within the housing; and a cam for being pivoted comprising an arm positioned proximate the receptacle opening for opening the receptacle opening when pivoted about the shaft and for moving the arm towards the conductor.

25. The connector assembly as recited in claim 24, wherein the button comprises an elongated main channel on a bottom side.

26. The connector assembly as recited in claim 24, wherein the arm moves away from the receptacle opening to open the receptacle opening when the cam is rotated by the button.

27. The connector assembly as recited in claim 24, further comprising a cantilever latch for latching the housing to a faceplate.

28. The connector assembly as recited in claim 24, further comprising a resilient member for pushing the cam to its first position and the button to its first position.

29. The connector assembly as recited in claim 24 wherein the housing is attached to a faceplate comprising a front surface and a rear surface and wherein a front wall of the housing is generally flushed with the front surface of the faceplate.

* * * * *